US006296285B1

(12) United States Patent
Alvring et al.

(10) Patent No.: US 6,296,285 B1
(45) Date of Patent: Oct. 2, 2001

(54) LOCKING HANDLE FOR REFRIGERATORS

(75) Inventors: Gunnar Alvring, Grebbestad; Kenneth Anderson; Per-Olof Lindqvist, both of Motala, all of (SE); Andrew Moseley, Herbom (DE); Bo Nilsson, Motala (SE)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/426,336

(22) Filed: Oct. 25, 1999

Related U.S. Application Data

(62) Division of application No. 09/075,612, filed on May 11, 1998, now Pat. No. 6,053,544.

(51) Int. Cl.[7] ..... E05C 1/04

(52) U.S. Cl. ..... 292/146; 292/175; 292/DIG. 71; 292/DIG. 63; 292/DIG. 21

(58) Field of Search ..... 292/336.3, 175, 292/169, DIG. 71, DIG. 21, DIG. 63, 166, 174, 143, 146; 312/296, 405

(56) References Cited

U.S. PATENT DOCUMENTS

| | | | | |
|---|---|---|---|---|
| 1,334,320 | * | 3/1920 | Schmidgall | 292/DIG. 71 |
| 1,417,815 | * | 5/1922 | Fischer | 292/DIG. 71 |
| 1,720,593 | * | 7/1929 | Geiser | 292/175 |
| 1,835,100 | * | 12/1931 | Symington | 292/DIG. 71 |
| 2,024,436 | | 12/1935 | Eickmeyer . | |
| 2,051,132 | | 8/1936 | Dart . | |
| 2,122,680 | | 7/1938 | Dart . | |
| 2,322,769 | | 6/1943 | Norberg . | |
| 2,568,383 | * | 9/1951 | Carroll | 292/166 |
| 2,642,728 | | 6/1953 | Thomaras . | |
| 2,828,991 | | 4/1958 | Stilger . | |
| 2,843,409 | * | 7/1958 | Johannesen | 292/DIG. 71 |
| 2,849,250 | | 8/1958 | Williamson . | |
| 2,947,559 | | 8/1960 | Olsson . | |
| 2,969,999 | * | 1/1961 | Herman | 292/166 |
| 3,346,289 | * | 10/1967 | Anderson | 292/175 |
| 3,678,716 | * | 7/1972 | Cobb | 70/92 |
| 4,109,950 | | 8/1978 | Amdal | 292/254 |
| 4,132,440 | | 1/1979 | Johnson | 292/341.19 |
| 4,740,022 | | 4/1988 | Takahashi | 292/217 |
| 4,875,745 | * | 10/1989 | Trulaske | 312/298 |
| 4,930,818 | | 6/1990 | Gerhardsson | 292/29 |
| 4,930,819 | * | 6/1990 | Sharp et al. | 292/42 |
| 5,387,018 | * | 2/1995 | Pinkerton | 292/259 R |
| 6,045,167 | * | 4/2000 | Lauterbach | 292/62 |

FOREIGN PATENT DOCUMENTS

| | | | | |
|---|---|---|---|---|
| 1005264 | * | 6/1947 | (FR) | 292/DIG. 71 |

* cited by examiner

*Primary Examiner*—Teri Pham Luu
(74) *Attorney, Agent, or Firm*—Pearne & Gordon LLP

(57) ABSTRACT

A locking handle for a refrigerator includes a mounting element rigidly secured to a refrigerator door, a hand grip rigidly secured to the mounting element, and a latch attached to the mounting element. The latch has a catch movable between a locked position and an unlocked position and an actuator operably connected to the catch for moving the catch from the locked position to the unlocked position. The latch provides a positive lock which is actuated to an unlocked position with a manipulation separate from pulling the hand grip but has an actuator located near the hand grip so that it can be manipulated by a hand grasping and pulling the hand grip. In a first embodiment, the catch is integrally molded with the mounting portion and is laterally deflectable away from a retainer mounted beside the door. In a second embodiment the catch is a vertically extending spindle which is downwardly movable away from a retainer mounted above the door.

9 Claims, 13 Drawing Sheets

16
14
44
12
PUSH
44
20
20
44
2
2
PUSH
44
12
38
18
10

LOCKING HANDLE FOR REFRIGERATORS

This application is a division of application Ser. No. 09/075,612, filed May 11, 1998, which issued as U.S. Pat. No. 6,053,544 on Apr. 25, 2000.

BACKGROUND OF THE INVENTION

The present invention generally relates to handles for refrigerator doors and, more specifically, to handles for refrigerator doors having a lock combined therewith.

Various types of handle structures for refrigerator doors are known. Typically, the refrigerator door has a handle mounted thereto for opening and closing the door but does not have a positive lock which prevents undesired opening of the door. This can be particularly troublesome when the refrigerator is located in a moving vehicle, such as a recreational vehicle, because various forces of the moving vehicle can cause the refrigerator door to open.

Many attempts have been made to provide refrigerator doors with positive locks. While these attempts may have successfully provided a positive lock, they each have drawbacks. For example, many of the locks are separate from the handle which makes it difficult and/or inconvenient to open the refrigerator door when necessary. Other handles are provided with locks which are manipulated simply by pulling the handle. These locks, however, are often complicated and expensive to manufacture and can allow the door to open under conditions where it is not desired. Such as, for example, were it is desired to keep children from opening the door.

Accordingly, there is a need in the art for a locking handle for a refrigerator which is relatively simple and inexpensive to produce, provides a sufficiently strong positive lock, and requires a manipulation separate from pulling the handle to open door.

BRIEF SUMMARY OF THE INVENTION

The present invention provides a locking handle for a refrigerator which overcomes at least some of the problems of the related art. According to the present invention, a refrigerator includes a cabinet defining an internal compartment having an opening, a door pivotally connected to the cabinet for selectively closing and opening the opening to provide access to the internal compartment, and a locking handle secured to the door. The cabinet has a retainer located adjacent the opening. The locking handle includes a mounting element rigidly secured to the door, a hand grip rigidly secured to the mounting element, and a latch attached to the mounting element. The latch has a catch movable between a locked position and an unlocked position and an actuator operably connected to the catch for moving the catch from the locked position to the unlocked position by a manipulation separate from pulling the hand grip. The catch and the retainer cooperate to prevent the door from opening when the catch is in the locked position and to allow the door to open when the catch is in the unlocked position. Preferably, the hand grip is generally U-shaped with a main bar and forming a space between the mounting element and the main bar. The actuator is located at the space defined by the hand grip so that it can be manipulated by a hand grasping the hand grip.

In a preferred embodiment, the retainer is located at the lateral side of the door. The catch is integral with the mounting portion and is laterally deflectable from the locked position to the unlocked position. The actuator is integral with the catch and extends to the space formed by the hand grip so that the actuator can be easily deflected by a hand grasping the hand grip.

In another preferred embodiment, the retainer is located vertically above the door. The catch is a spindle vertically extending and movable between a locked position and an unlocked position. A spring element upwardly biases the spindle to the locked position and the actuator axially moves the spindle downward from the locked position to the unlocked position.

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENTS

Figure 1:
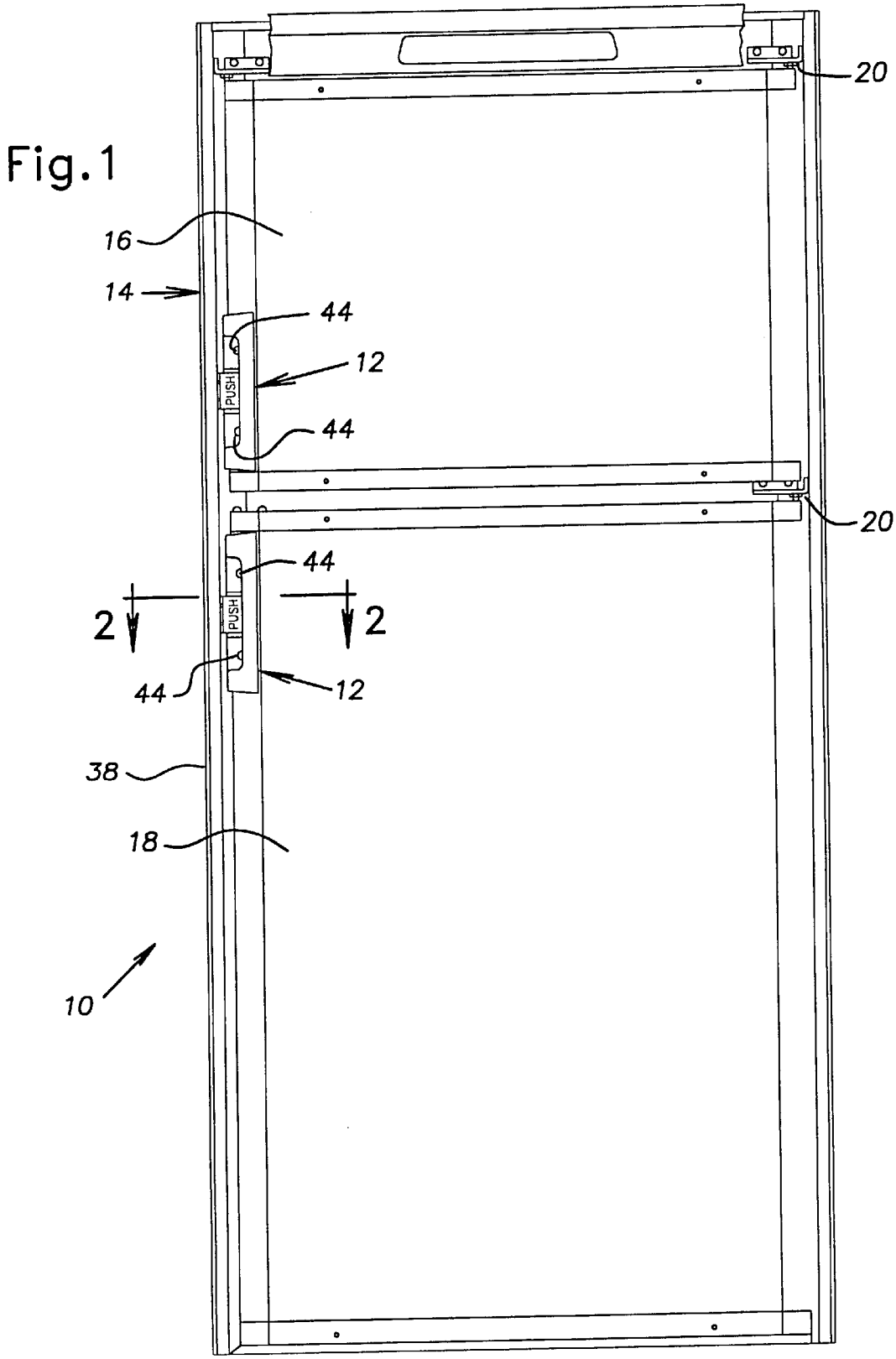
FIG. 1 is a front elevational view of a double-door refrigerator having locking handles according to the present invention.

FIG. 1 illustrates a double-door refrigerator 10 having locking handles 12 according to the present invention. The term refrigerator as used in the specification and claims is intended to include refrigerators, freezers, and other such refrigerated containers. It is noted that while the illustrated refrigerator 10 is a double door-refrigerator, refrigerators having other quantities or configurations of doors are within the scope of the present invention.

The illustrated refrigerator 10 includes an insulated cabinet 14, an upper insulated door 16, and a lower insulated door 18. The cabinet 14 is divided into an upper compartment having a forward facing opening and a lower compartment having a forward facing opening. Typically, one of the compartments is used as a freezer compartment and the other compartment is used as a food storage compartment. The upper door 16 is mounted on the cabinet 14 by hinges 20 for closing and opening the opening of the upper compartment to provide access therein as required. Similarly, the lower door 18 is mounted on the cabinet 14 by hinges 20 for closing and opening the opening of the lower compartment to provide access therein as required.

Figure 2:
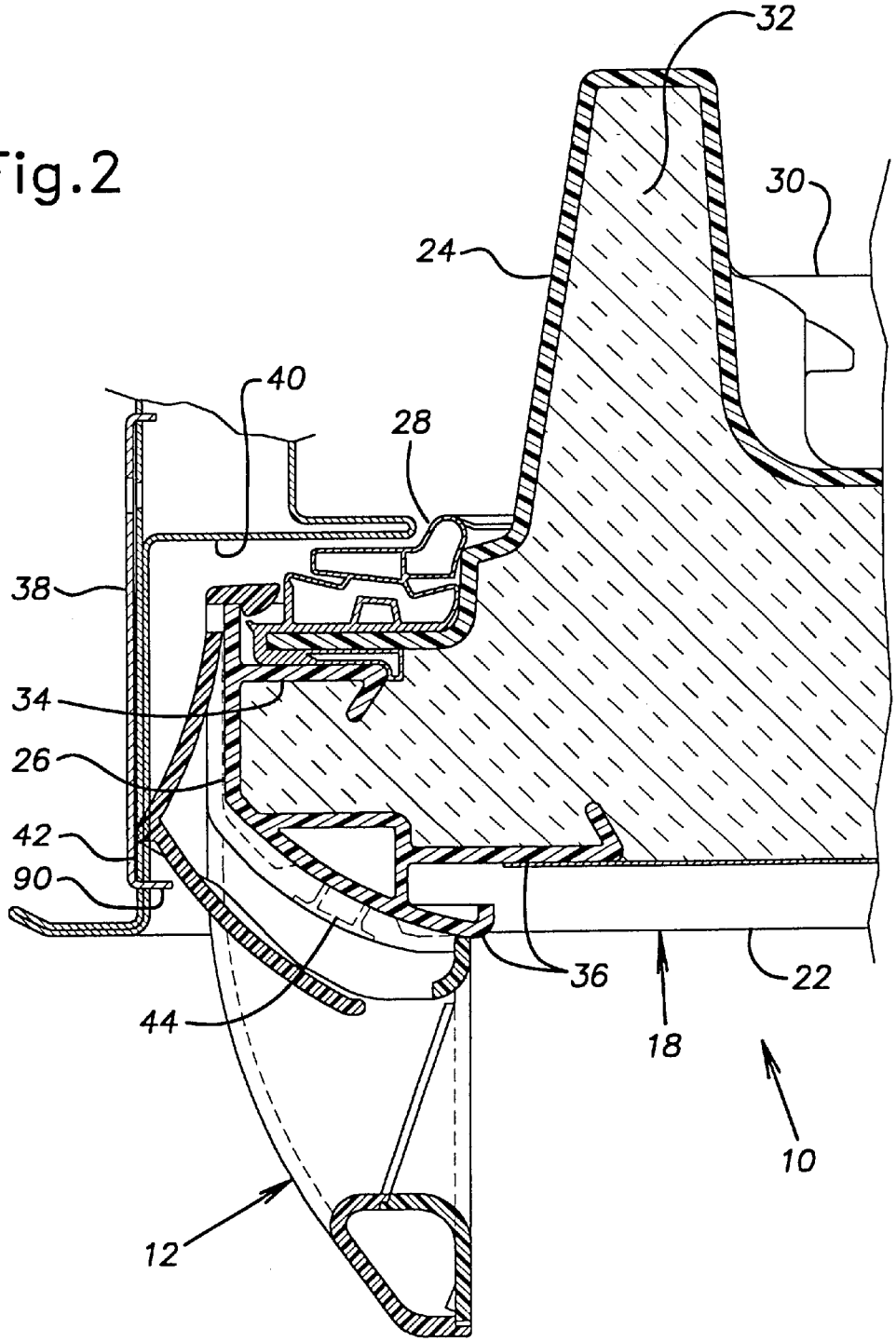
FIG. 2 is an enlarged sectional view taken along line 2—2 of FIG. 1.
Figure 3:
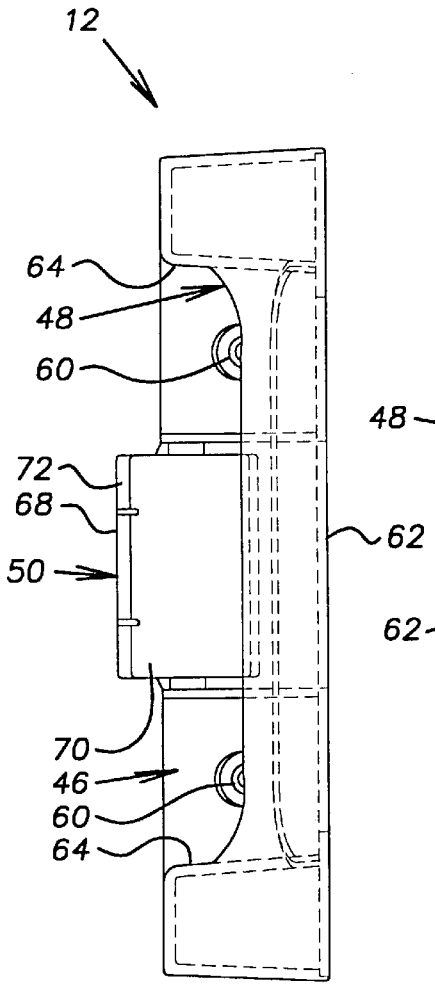
FIG. 3 is an enlarged front elevational view of a handle assembly of the double-door refrigerator of FIG. 1.
Figure 4:
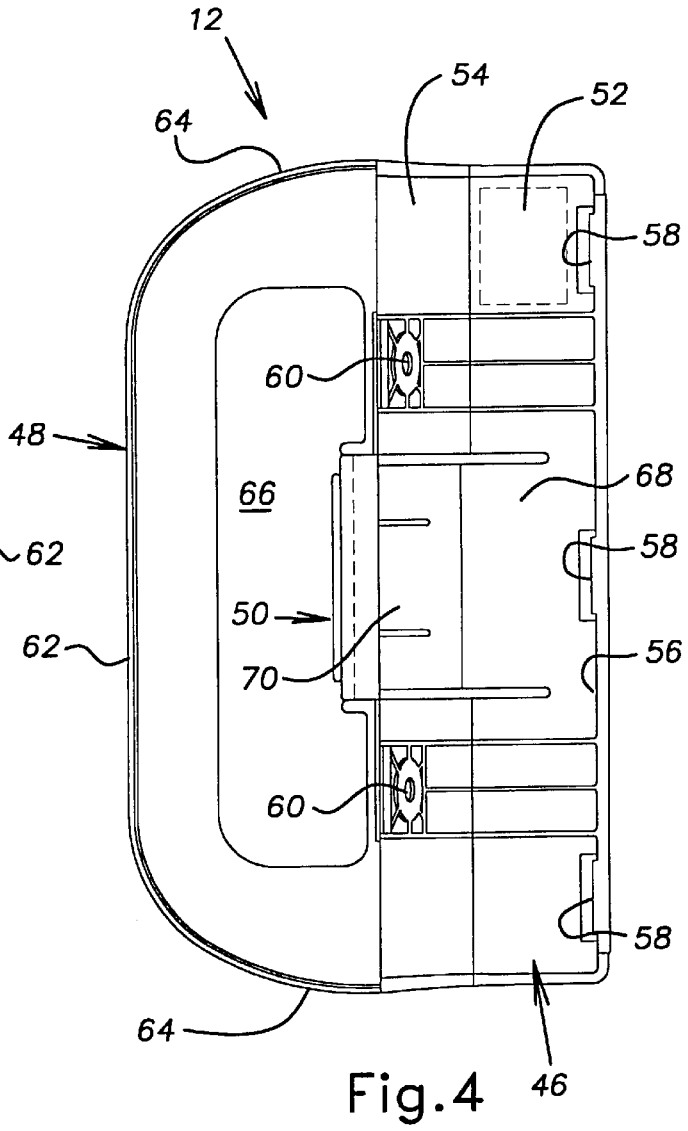
FIG. 4 is a left side elevational view of the handle assembly of FIG. 3.
Figure 5:
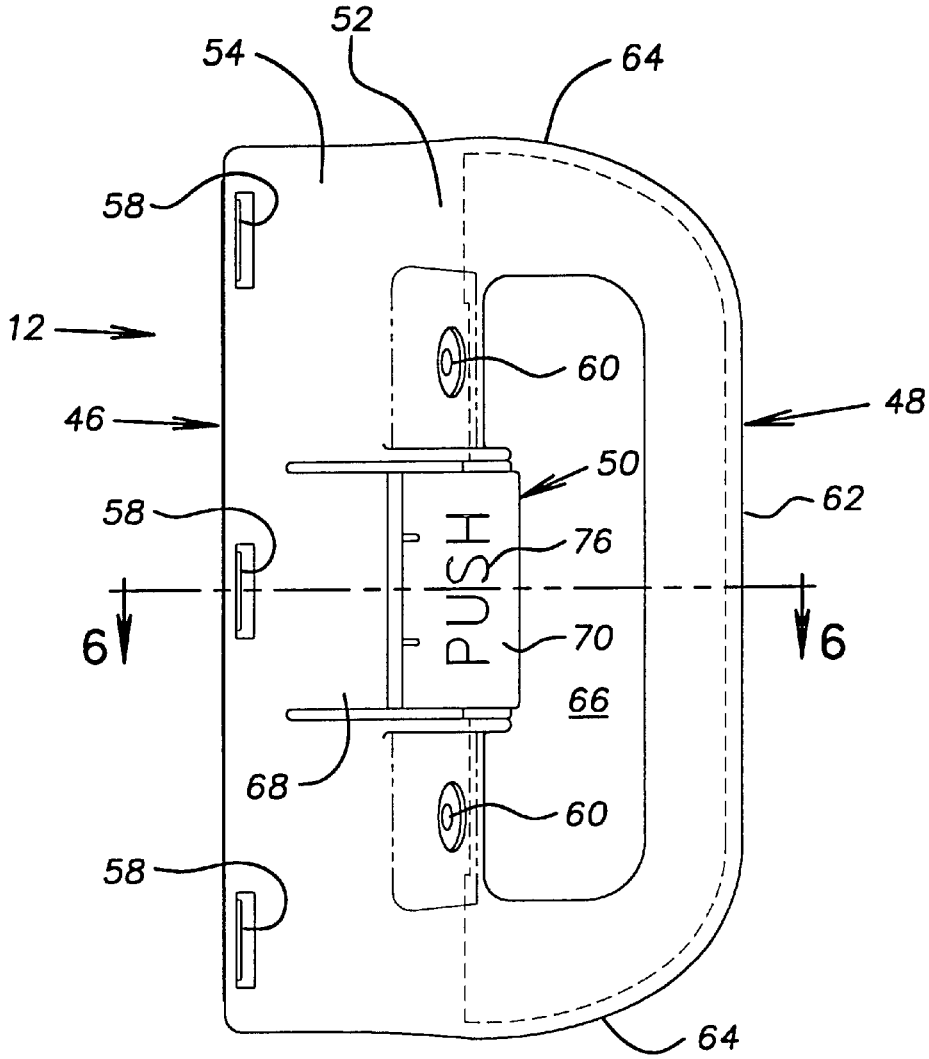
FIG. 5 is a right side elevational view of the handle assembly of FIG. 3.
Figure 6:
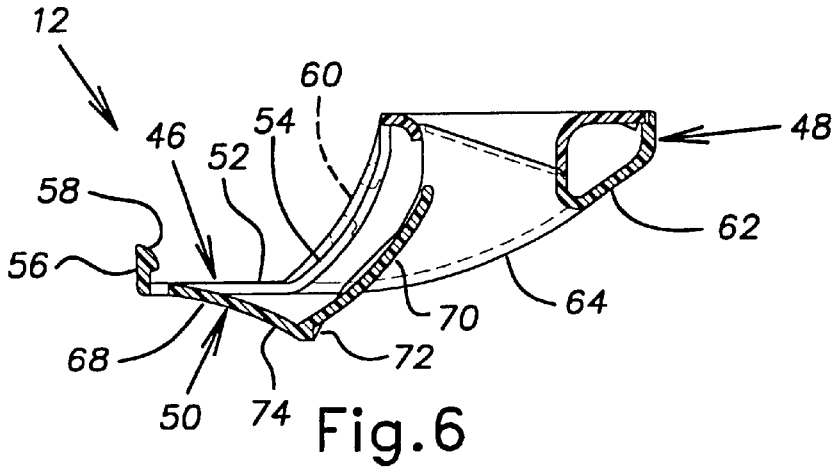
FIG. 6 is a sectional view taken along line 6—6 of FIG. 5.

As best shown in FIG. 2, each of the doors 16, 18 includes an outer shell or panel 22, an inner liner or panel 24, edge members or strips 26, a seal or gasket 28, and one of the locking handles 12. Each of the doors 16, 18 are typically constructed in the same manner, therefore, only the lower door 18 is described in detail with the understanding that the description applies equally to the upper door 16.

As best shown in FIGS. 1 and 2, the outer panel 22 is generally planar and rectangularly shaped and forms the front face of the door 18. The inner panel 24 is typically molded plastic and is provided with shelves and/or compartments 30 for storing foodstuffs on the inner side of the door 18. The edge strips 26 connect and space-apart the inner and outer panels 22, 24. An internal space formed between the inner an outer panels 22, 24 is filled with a foam insulation 32.

The edge strip 26 has a generally planar rear portion forming a lateral or outer side edge of the door 18 and an arcuate front portion extending from the rear portion to the outer panel 22 to form a "beveled" front corner. The rear portion of the edge strip 26 has an inwardly extending rear flange 34 which cooperates with the outer edge of the inner panel 24 to capture and retain the gasket 28 therebetween. The rear flange 34 is spaced forward of the rear end of the edge strip rear portion. The forward end of the edge strip 26 has a pair of inwardly extending and spaced apart front flanges 36 which capture and retain the edge of the outer panel 22 therebetween.

The gasket 28 is provided about the periphery of the door 18 at the outer edge of the inner panel 24 to seal the door 18 to the frame 38 forming the opening of the compartment. The gasket 28 preferably engages a forward-facing surface 40 of the frame 38 when the door 18 is closed. The gasket 28 can be of any suitable type known to those skilled in the art.

The locking handle 12 is secured to the door 18 on the lateral outer side, that is, the lateral side opposite the hinges 20. The locking handle 12 is located adjacent a retainer 42 of the frame 38 located at a lateral side of the door 18. The retainer 42 and locking handle 12 cooperate to automatically secure the door 18 in a closed position as described in more detail hereinafter.

The locking handle 12 is also positioned at the edge of the door 18 adjacent the front surface of the door outer panel 22. Fasteners 44 preferably extend through the locking handle 12 into the edge strip 26 of the door 18 to eliminate the need for fastener openings in the front face of the door outer panel 22.

As best shown in FIGS. 3–6, the locking handle 12 includes a mounting element 46, a hand grip 48, and a latch 50. The mounting element 46 has a generally planar rear portion 52 and an arcuate front portion 54 extending from the front of the rear portion 52. The rear and front portions 52, 54 cooperate to closely conform to the shape of the door edge strip 26 (best shown in FIG. 2).

The rear portion 52 of the mounting element has an inwardly extending flange 56 sized and shaped to extend past the rear end of the door edge strip 26 (best shown in FIG. 2). The flange 56 is provided with a plurality of vertically spaced-apart and forwardly extending protrusions 58 sized and shaped to secure the rear end of the mounting element 46 to the rear end of the edge strip 26. The illustrated embodiment is provided with three protrusions 58 but a greater or lesser number can be utilized.

The front portion 54 of the mounting element 46 is provided with a pair of vertically spaced apart openings 60 sized and shaped for receiving the fasteners 44. The openings 60 are located on opposite sides of the latch 50. Preferably, the openings 60 are provided with a counterbore such that heads of the fasteners 44 are generally flush with the outer surface of the mounting element 46 when installed. The illustrated embodiment is provided with two openings 60 but a greater or lesser number can be utilized.

The hand grip 48 is integral with the mounting element 46 and is generally U-shaped. The hand grip 48 includes a vertically extending main arm or bar 62 and legs 64 which extend between ends of the main bar 62 and the mounting element 46. The hand grip 48 is generally straight and has a cross-section sized and shaped for gasping by a hand. The legs 64 are generally parallel to each other and generally perpendicular to the main bar 62. The legs 64 connect and secure the main bar 62 to the arcuate portion 54 of the mounting element 46 with an open space 66 therebetween for wrapping a hand around the main bar 62.

The legs 64 generally extend across the width of the arcuate portion 54 of the mounting element 46. The lateral side of the hand grip 48 adjacent the planar portion 52 of the mounting element 46 is arcuate. The lateral side of the hand grip 48 opposite the planar portion 52 of the mounting element 46 is generally planar and generally parallel to the planar portion 52.

The latch 50 is integral with the mounting element 46 and is vertically located between the legs 64 of the hand grip 48. Preferably, the latch 50 is substantially midway between the legs 64 of the hand grip 48. The latch 50 includes a catch 68 and an actuator 70.

The catch 68 extends forward and laterally outward from the rear of the mounting element 46. A forward facing abutment 72 is formed by the forward end of the catch 68. The abutment 72 is sized and shaped to cooperate with the door frame retainer 42 to lock the refrigerator door 18 closed when in a locked position as described in more detail hereinafter. The catch 68 is preferably provided with a camming surface 74 such that the catch 68 is automatically deflected out the locking position as the door 18 is closed.

The actuator 70 extends forward and laterally inward from the catch 68. The actuator 70 preferably extends from the forward end of the catch 68. The actuator 70 is sized and shaped to selectively move the catch 68 from the locked position (best shown in FIG. 6) to an unlocked position when it is desired to open the door 18. The actuator 70 preferably extends to a position located generally between the legs 64 of the hand grip 48 and into the open space 66 so that it can be easily manipulated by one or more fingers of a hand grasping the main bar 62.

In the illustrated embodiment, the catch 68 of the latch 50 is integral with the mounting element 46 so that it resiliently deflectable and movable to the unlocked position when a "pushing" or laterally inward directed force is applied to the actuator 70 as described in more detail hereinafter. The actuator 70 is preferably provided with indicia 76 indicating the necessary manipulation required to move the latch 50 to the unlocked position such as, for example, the word "push".

The locking handle 12 is preferably molded from a plastic material. The locking handle 12 can, however, be assembled from two or more separate parts such as, for example, a handle member 12*a* and a cover member 12*b*. Both the handle member 12*a* and the cover member 12*b* are preferably injection-molded plastic parts. The handle member 12*a* and the cover member 12*b* are secured together in any suitable manner such as, for example, ultrasonic welding.

Figure 7:
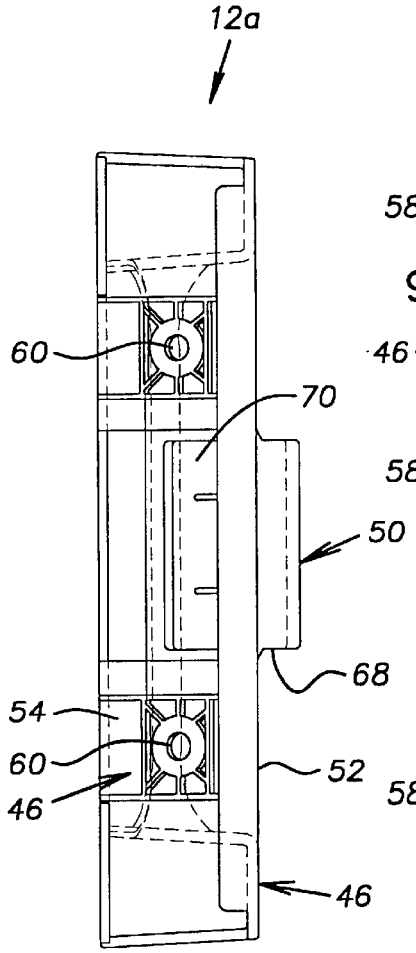
FIG. 7 is a rear elevational view of a handle member of the handle assembly of FIG. 3.
Figure 8:
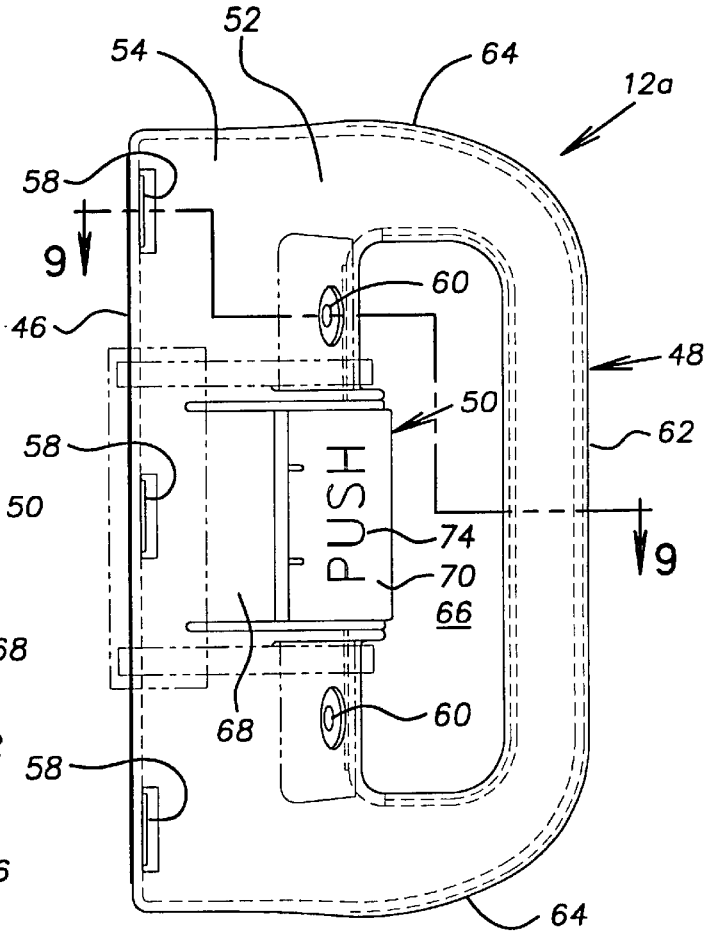
FIG. 8 is a right side elevational view of the handle member of FIG. 7.
Figure 9:
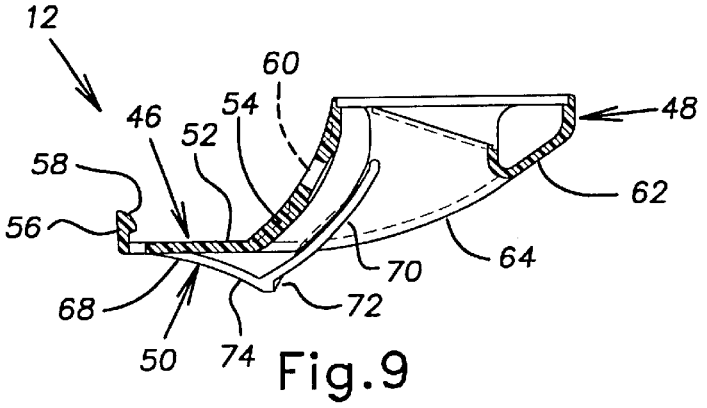
FIG. 9 is a sectional view taken along line 9—9 of FIG. 8.
Figure 10:
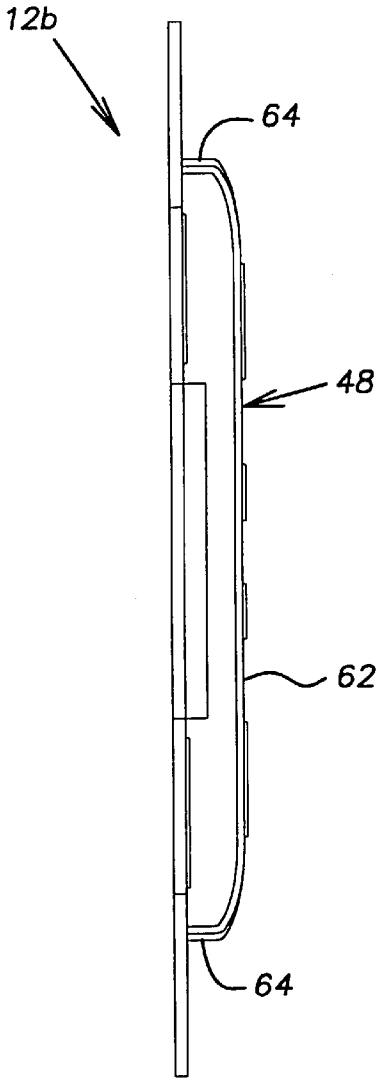
FIG. 10 is a rear elevational view of a cover member of the handle assembly of FIG. 3.
Figure 11:
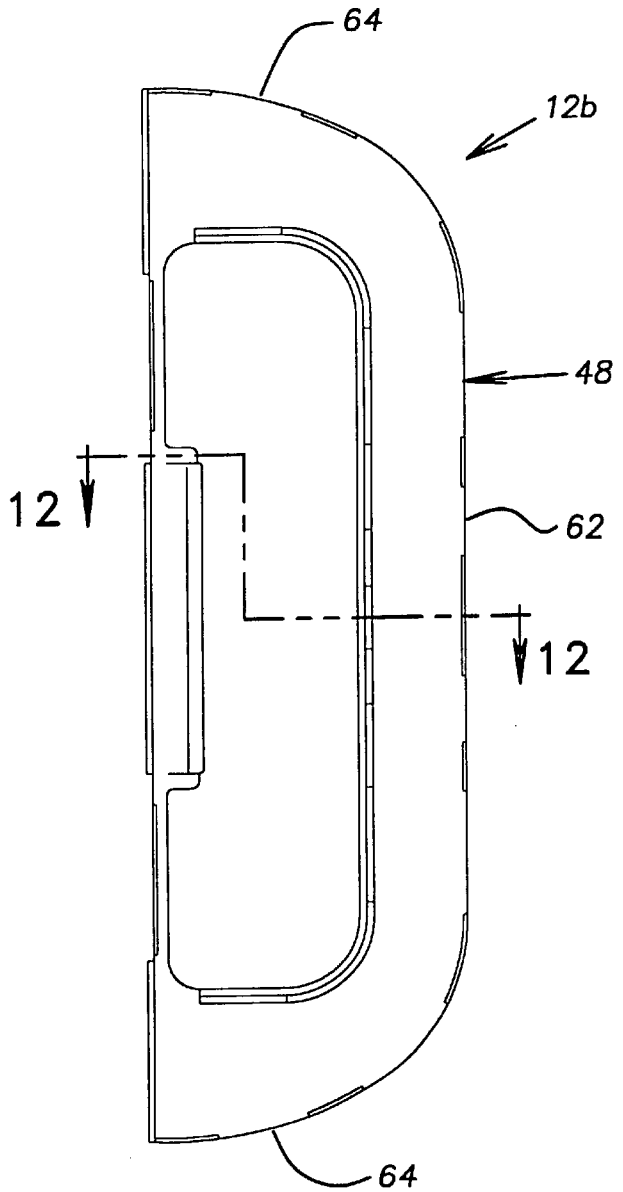
FIG. 11 is a right side elevational view of the cover member of FIG. 7.
Figure 12:
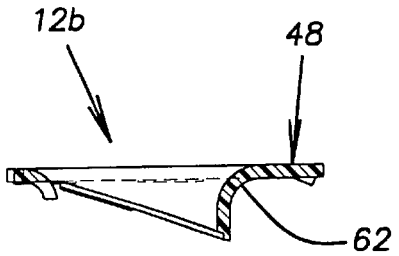
FIG. 12 is a sectional view taken along line 11—11 of FIG. 11.

As best shown in FIGS. 7–9, the handle member 12*a* substantially forms all of the locking handle 12 except for one lateral side of the hand grip 48 which is generally open. As best shown in FIGS. 10–12, the cover member 12*b* is sized and shaped to form the lateral side of the hand grip 48 which is open on the handle member 12*a*. Therefore, the handle member 12*a* and the cover member 12*b* cooperate to form the locking handle 12 as described herein above in detail with reference to FIGS. 5–9.

Figure 13:
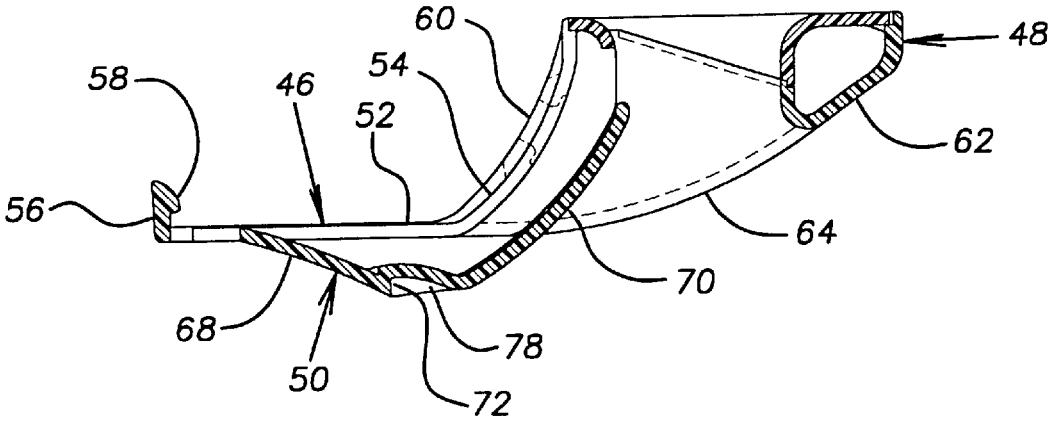
FIG. 13 is a sectional view, similar FIG. 6, of a second embodiment of a handle assembly.

FIG. 13 illustrates a variation of the locking handle 12 wherein like reference numbers are used for like structure. This locking handle 12 is substantially the same as the locking handle 12 described hereinabove except that the abutment 72 of the catch 68 is generally within a recess 78 formed in the actuator 70.

As best shown in FIGS. 1 and 2, the latch 50 of the locking handle 12 and the retainer 42 of the cabinet 14 cooperate to lock the door 18 closed, that is, prevent the door 18 from opening. The door 18 is prevented from opening because the forward facing abutment 72 of the catch 68 engages a rearward facing abutment of the retainer 42.

When it is desired to open the door 18, the operator grasps the hand grip 48 with their hand and presses the actuator 70 of the latch 50 toward the mounting element 46. The movement of the actuator 70 deflects the catch 68 toward the mounting element 46 from the locked position to the unlocked position wherein the catch 68 is free of the retainer 42. Once the catch 68 is in the unlocked position, the operator pulls on the hand grip 48 to pivot the door 18 open about the hinges 20. The catch 68 resiliently returns to the locked position when the actuator 70 is released by the operator.

When the door 18 is closed, the latch 50 of the locking handle 12 automatically locks the door 18. As the door 18 approaches the closed position, the camming surface 74 of the catch 68 engages a cam 80 of the cabinet 14 which deflects the catch 68 to the unlocked position. When the catch 68 is beyond the abutment, it resilient returns to the locked position and locks the door 18. The above described procedure is repeated whenever the door 18 is opened and closed.

It can be seen from the above description that the locking handle 12 of the present invention provides a positive lock which firmly holds the door 18 closed and can be easily and conveniently actuated to an unlocked position to open the door 18 with a single hand. Additionally, the door 18 is automatically locked when closed so that a separate locking manipulation, which may be inconvenient and/or forgotten, is not required. Furthermore, a manipulation separate from pulling the hand grip 48 is required to unlock the door 18.

Figure 14:
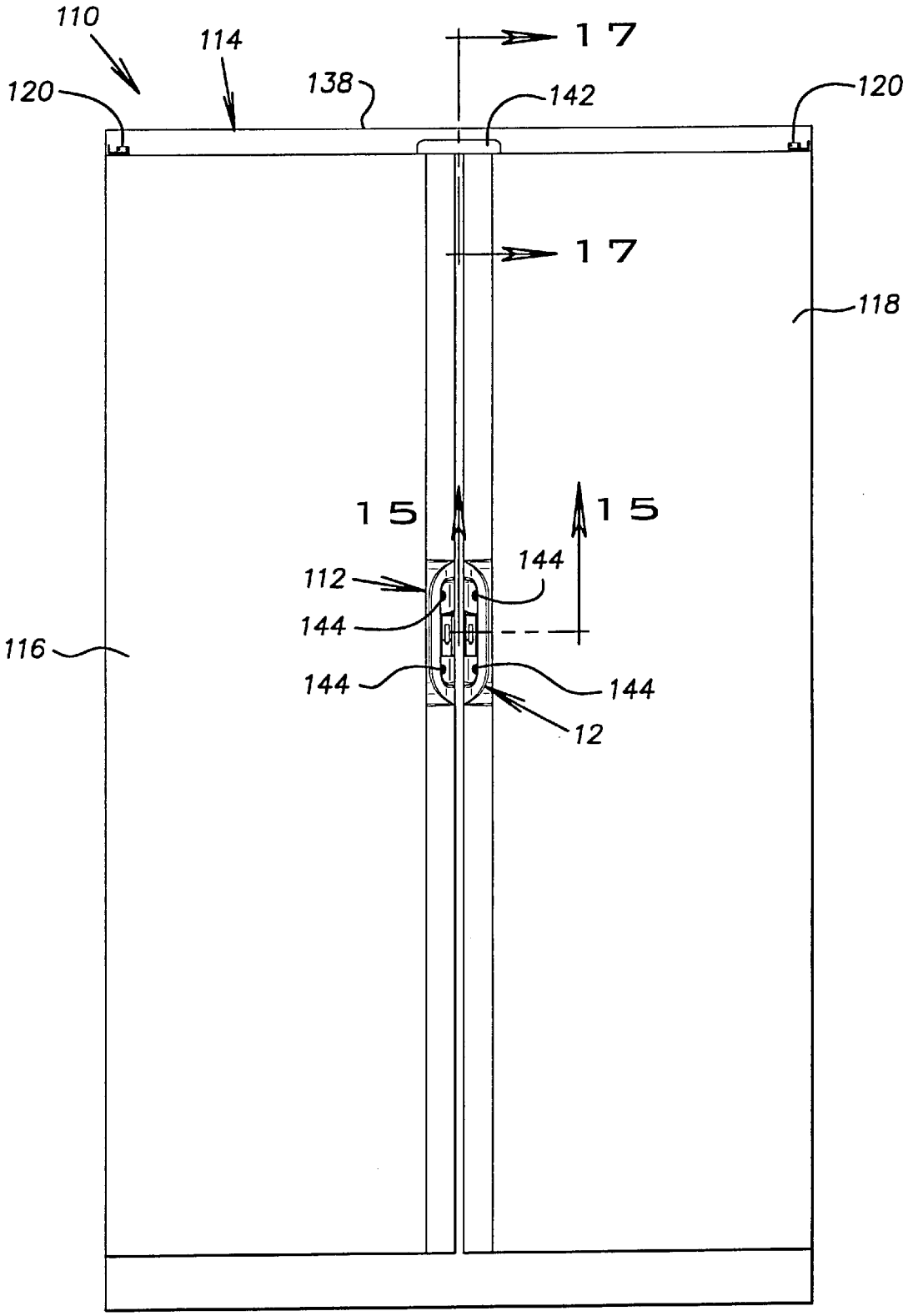
FIG. 14 is a front elevational view of a side-by-side refrigerator having locking handles according to the present invention.

FIG. 14 illustrates a side-by-side refrigerator 110 having locking handles 112 according to the present invention. The illustrated refrigerator 110 includes an insulated cabinet 114, a right insulated door 116, and a left insulated door 118. The cabinet 114 is divided into a right compartment having a forward facing opening and a left compartment having a forward facing opening. Typically, one of the compartments is used as a freezer compartment and the other compartment is used as a food storage compartment. The right door 116 is mounted on the cabinet 114 by hinges 120 for closing and opening the opening of the right compartment to provide access therein as required. Similarly, the left door 118 is mounted on the cabinet 114 by hinges 120 for closing and opening the opening of the left compartment to provide access therein as required.

Figure 15:
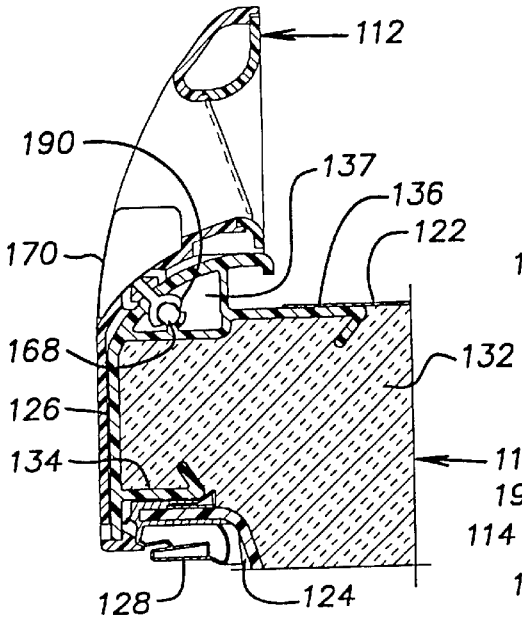
FIG. 15 is an enlarged sectional view taken along line 15—15 of FIG. 14.

As best shown in FIG. 15, each of the doors 116, 118 includes an outer shell or panel 122, an inner liner or panel 124, edge members or strips 126, a seal or gasket 128, and one of the locking handles 112. Each of the doors 116, 118 are typically constructed in the same manner, therefore, only the left door 118 is described in detail with the understanding that the description applies equally to the right door 116.

As best shown in FIGS. 14 and 15, the outer panel 122 is generally planar and rectangularly shaped and forms the front face of the door 118. The inner panel 124 is typically molded plastic and is provided with shelves and/or compartments for storing foodstuffs on the inner side of the door 118. The edge strips 126 connect and space-apart the inner and outer panels 122, 124. An internal space formed between the inner an outer panels 122, 124 is filled with a foam insulation 132.

The edge strip 126 has a generally planar rear portion forming a lateral or outer side edge of the door and an arcuate front portion extending from the rear portion to the outer panel 122 to form a "beveled" front corner. The rear portion of the edge strip 126 has an inwardly extending rear flange 134 which cooperates with the outer edge of the inner panel 124 to capture and retain the gasket 128 therebetween. The rear flange 134 is spaced forward of the rear end of the edge strip rear portion. The forward end of the edge strip 126 has an inwardly extending front flange 136 to which an edge of the outer panel 122 is secured. Inner walls form a vertically extending hollow space 137 behind the forward portion of the edge strip.

The gasket 128 is provided about the periphery of the door 118 at the outer edge of the inner panel 124 to seal the door 118 to the frame forming the opening of the compartment. The gasket 128 preferably engages a forward-facing surface of the frame when the door 118 is closed. The gasket 128 can be of any suitable type known to those skilled in the art.

Figure 17:
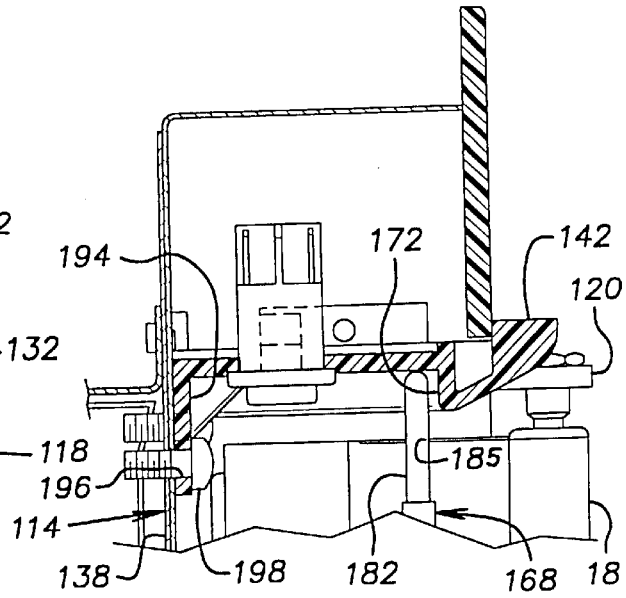
FIG. 17 is an enlarged sectional view taken along line 17—17 of FIG. 14.

The locking handle 112 is secured to the door 118 on the lateral inner side, that is, the lateral side opposite the hinges 120. As best shown in FIGS. 14 and 17, a retainer 142 is rigidly secured to the cabinet frame 138 directly above the door 118 and the locking handle 112. The retainer 142 and locking handle 112 cooperate to automatically secure the door 118 in a closed position as described in more detail hereinafter.

Figure 16:
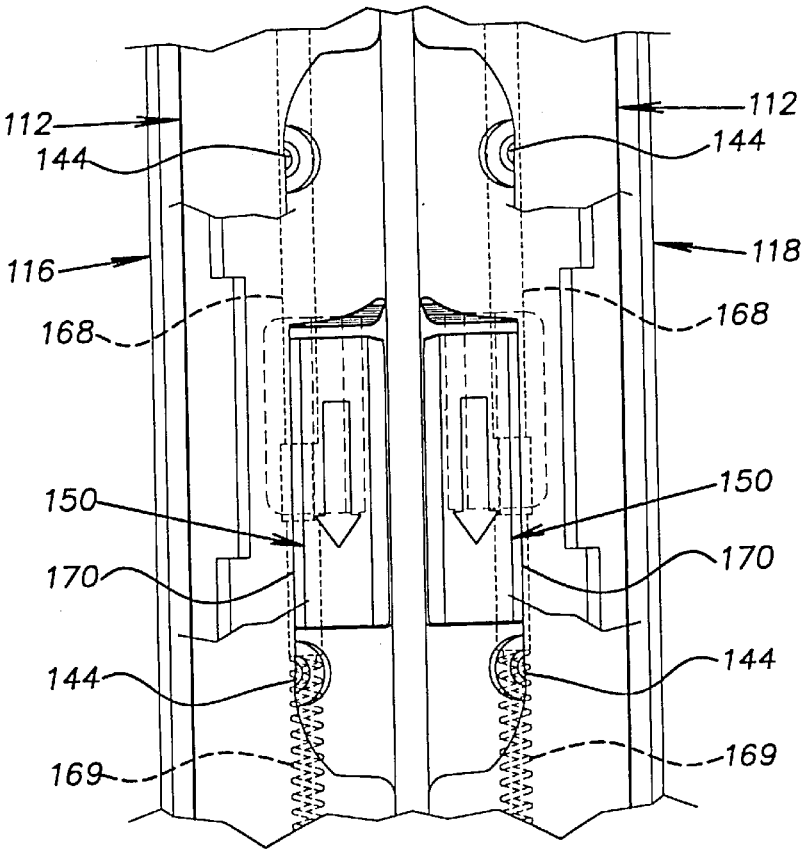
FIG. 16 is an enlarged view of a portion of FIG. 14 showing the locking handles with portions cut away to show internal components.
Figure 18:
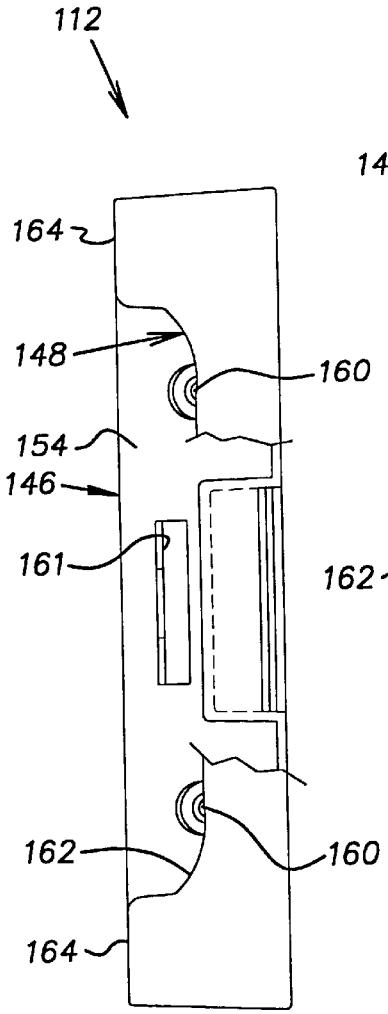
FIG. 18 is an enlarged front elevational view of a handle assembly of the side-by-side refrigerator of FIG. 14.
Figure 19:
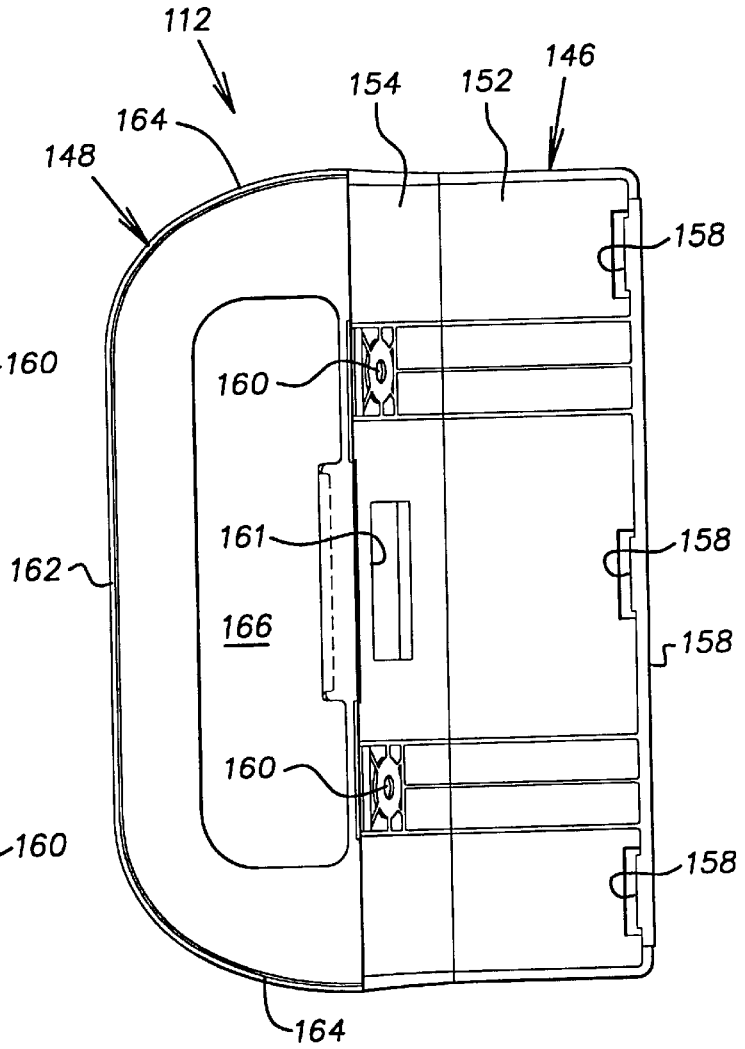
FIG. 19 is a left side elevational view of the handle assembly of FIG. 18.
Figure 20:
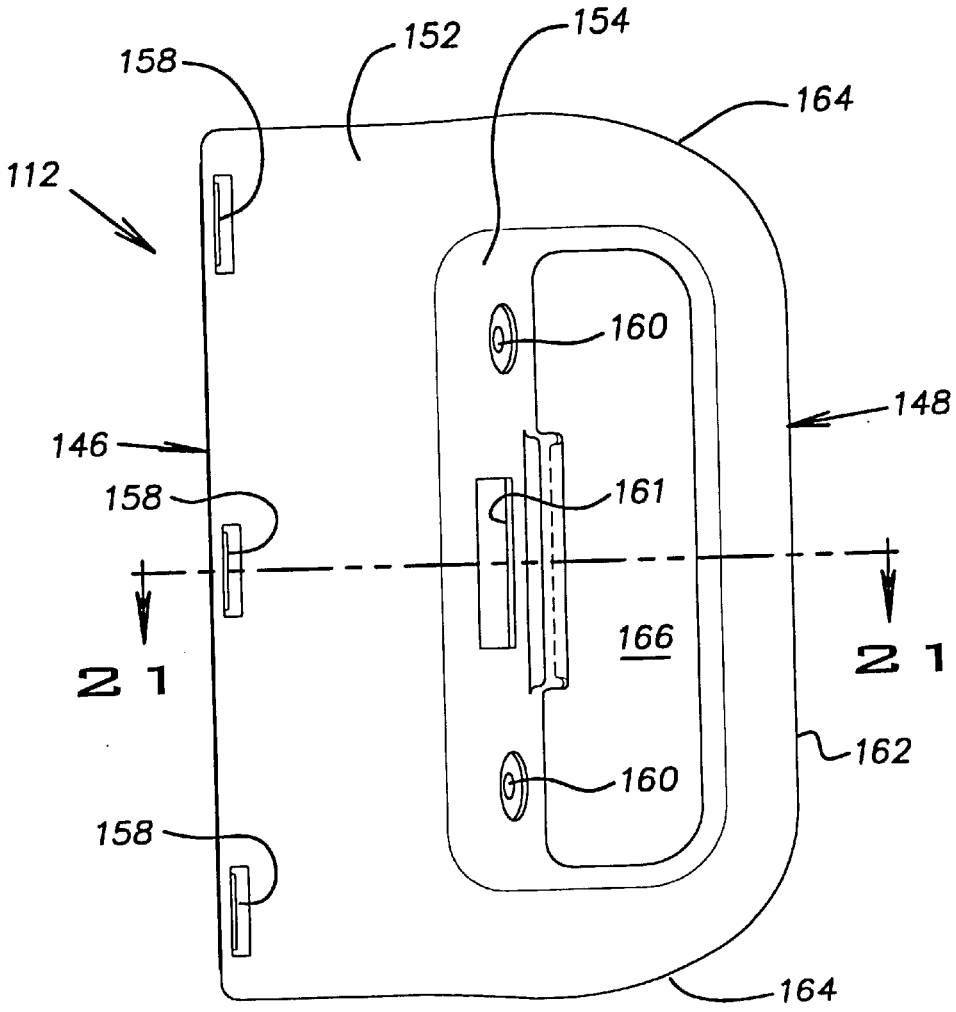
FIG. 20 is a right side elevational view of the handle assembly of FIG. 18.
Figure 21:
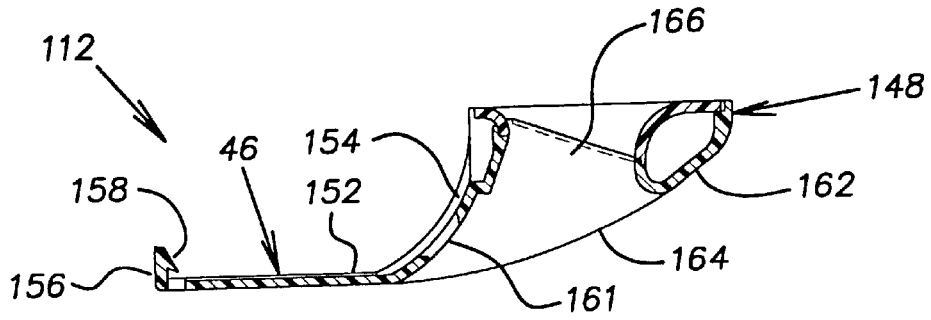
FIG. 21 is a sectional view taken along line 21—21 of FIG. 18.

As best shown in FIGS. 14–16, the locking handle 112 is also positioned at the edge of the door 118 adjacent the front surface of the door outer panel 122. Fasteners 144 preferably extend through the locking handle 112 into the edge strip 126 of the door 118 to eliminate the need for fastener openings in the front face of the door outer panel 122.

As best shown in FIGS. 18–21, the locking handle 112 includes a mounting element 146 and a hand grip 148. The mounting element 146 has a generally planar rear portion 152 and an arcuate front portion 154 extending from the front of the rear portion 152. The rear and front portions 152, 154 cooperate to closely conform to the shape of the door edge strip 126 (best shown in FIG. 15).

The rear portion 152 of the mounting element has an inwardly extending flange 156 sized and shaped to extend past the rear end of the door edge strip 126 (best shown in FIG. 15). The flange 156 is provided with a plurality of vertically spaced-apart and forwardly extending protrusions 158 sized and shaped to secure the rear end of the mounting element 146 to the rear end of the edge strip 126. The illustrated embodiment is provided with three protrusions 158 but a greater or lesser number can be utilized.

The front portion 154 of the mounting element 46 is provided with a pair of vertically spaced apart openings 160 sized and shaped for receiving the fasteners 144. The openings 160 are located on opposite sides of the latch element 150. Preferably, the openings 160 are provided with a counterbore such that heads of the fasteners 144 are generally flush with the outer surface of the mounting element 146 when installed. The illustrated embodiment is provided with two openings 160 but a greater or lesser number can be utilized. The front portion 154 of the mounting element 146 is also provided with a vertically extending slot 161. The slot is vertically located between the openings 160 and is laterally offset therefrom.

The hand grip 148 is integral with the mounting element 146 and is generally U-shaped. The hand grip 148 includes a vertically extending main arm or bar 162 and legs 164 which extend between ends of the main bar 162 and the mounting element 146. The hand grip 148 is generally straight and has a cross-section sized and shaped for gasping by a hand. The legs 164 are generally parallel to each other and generally perpendicular to the main bar 162. The legs 164 rigidly connect and secure the main bar 62 to the arcuate portion 154 of the mounting element 146 with an open space 166 therebetween for wrapping a hand around the main bar 162.

The legs 164 generally extend across the width of the arcuate portion 154 of the mounting element 146. The lateral side of the hand grip 148 adjacent the planar portion 152 of the mounting element 146 is arcuate. The lateral side of the hand grip 148 opposite the planar portion 152 of the mounting element 146 is generally planar and generally parallel to the planar portion 152.

The locking handle 112 is preferably molded from a plastic material. The locking handle 12, however, can be assembled from two or more separate parts such as described hereinabove with reference to the first embodiment of the present invention.

As best shown in FIG. 16, the locking handle 112 also includes a latch 150. The latch 150 includes a catch or spindle 168, a spring member element 169, and an actuator 170. The latch actuator 170 is vertically located between the legs 164 of the hand grip 148. Preferably, the latch actuator 170 is substantially midway between the legs 164 of the hand grip 148.

Figure 25:
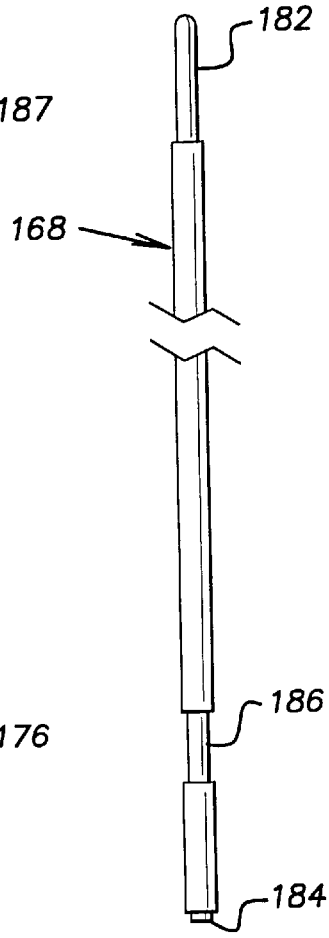
FIG. 25 is an elevational view of a spindle of the side-by-side refrigerator of FIG. 14.

As best shown in FIG. 25, the spindle 168 is preferably an elongate rod. The upper end of the spindle 168 is provided with a reduced diameter portion 182 forming an upward facing abutment. Preferably, the upper end is rounded to cooperate with the retainer 142 as described in more detail hereinafter. The lower end of the spindle 168 is provided with a reduced diameter portion 184 forming a downward facing abutment. The lower reduced diameter portion 184 is sized to cooperate with the spring element 169 as described in more detail hereinafter. An intermediate reduced diameter portion 186 forming upward and downward facing abutments is provided near the lower reduced diameter portion 184. The intermediate reduced diameter portion 186 is sized and shaped to cooperate with the actuator 170 as described in more detail herein after.

As best shown in FIGS. 15–17, the spindle 168 vertically extends through the hollow interior space 137 of the door edge strip 126 from the locking handle 112 to the retainer 142. The upper reduced diameter portion 182 of the spindle 168 extends through an opening 188 in the top of the door 118. The spring element 169 is located at the bottom of the spindle 168 and is secured thereto by extending over the lower reduced diameter portion. The spring element 169 resiliently biases or urges the spindle 168 in an upward direction to a locked position (shown in FIG. 17). The spring element 169 is preferably a helical spring but can alternatively be any suitable type of spring which provides a bias or urging force to the spindle 168.

Figure 24:
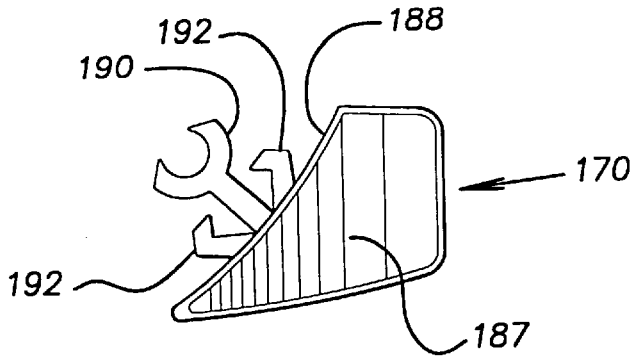
FIG. 24 is a top plan view of the control knob of FIG. 22.
Figure 22:
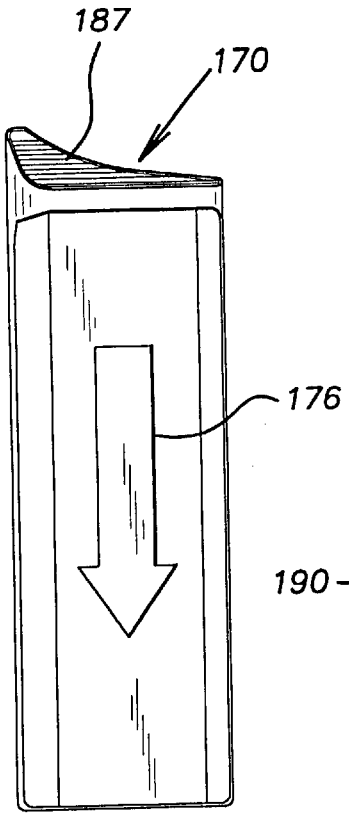
FIG. 22 is an enlarged front elevational view of a control knob of the side-by-side refrigerator of FIG. 14.
Figure 23:
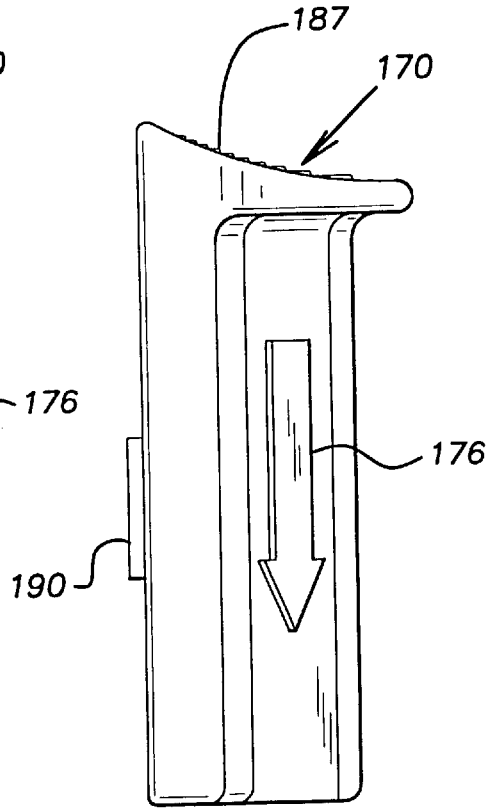
FIG. 23 is a side elevational view of the control knob of FIG. 22.

As best shown in FIGS. 22–24, the actuator 170 is sized and shaped to selectively move the spindle 168 from the locked position to an unlocked position when it is desired to open the door 118. The actuator 170 has a top surface 187 which is shaped for comfortably applying a downward force thereto by the operator while grasping the hand grip 148. Preferably the top surface is provided with means for increasing the frictional resistance thereof. The actuator 170 is preferably molded from a plastic material. The actuator 170 has an inner surface 188 sized and shaped to closely conform to the front portion 154 of the mounting element 146 (best shown in FIG. 15). Rearwardly extending from the inner surface 188 are connector 190 and a pair of engagement legs 192. The connector 190 is sized and shaped to secure the actuator 170 to the spindle 168 for movement therewith. In the illustrated embodiment, the connector 190 partially encircles the intermediate reduced diameter portion 186 of the spindle 168 and engages the upward and downward facing abutments. The engagement legs 192 rearwardly extend on opposite sides of the connector 190 and are sized and shaped to slidably secure the actuator 170 to the front portion 154 of the mounting element 146.

As best shown in FIGS. 15 and 16, the connector 190 of the actuator 70 extends through the slot 161 in the front portion 154 of the mounting element 146 to the spindle 168. In this position, the actuator 70 is located generally between the legs 64 of the hand grip 48 and in the open space 66 so that it can be easily manipulated by one or more fingers of a hand grasping the main bar. The legs 192 also extend through the slot 161 of mounting element 146. The legs 192 are adapted such that they retain the actuator 170 in the slot 161 but allow upward and downward movement in the slot 161.

The actuator 170 is movable, along with the spindle 168 secured thereto, to an unlocked position when a "pushing" or downwardly directed force is applied to the actuator 170 as described in more detail hereinafter. The actuator 170 is preferably provided with indicia 176 indicating the necessary manipulation required to move the latch 150 to the unlocked position such as, for example, a downwardly directed arrow.

Figure 26:
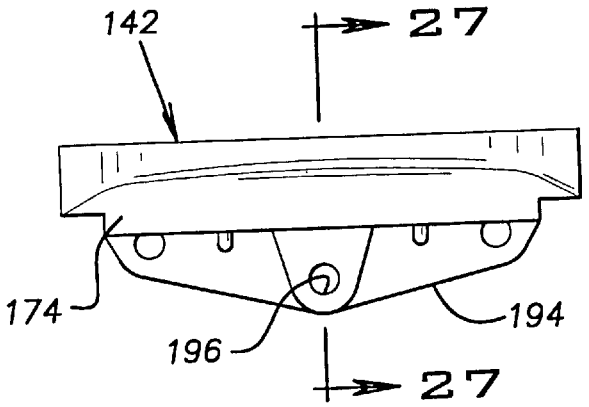
FIG. 26 is an enlarged rear elevational view of a retainer of the side-by-side refrigerator of FIG. 14.
Figure 27:
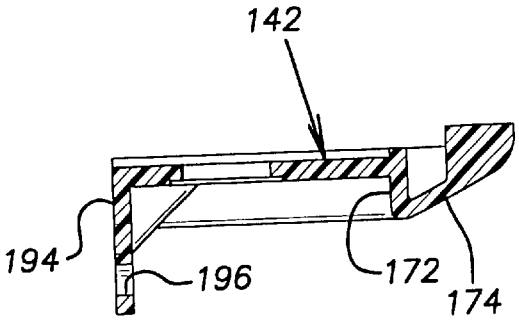
FIG. 27 is a sectional view taken along line 27—27 of FIG. 22.
Figure 28:
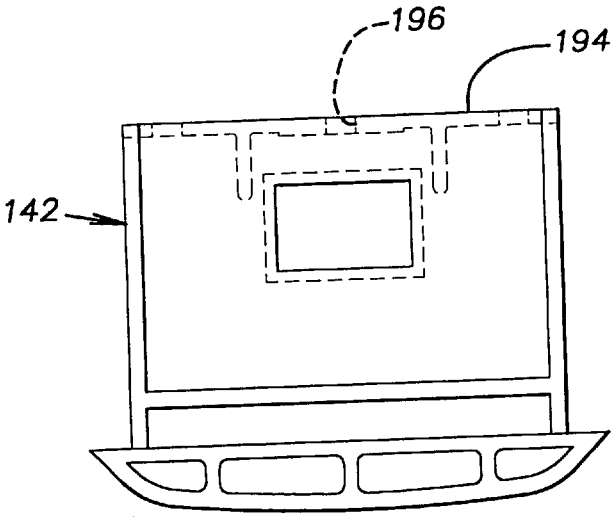
FIG. 28 is a top plan view of the retainer of FIG. 26.

As best shown in FIGS. 26–27, the retainer 142 forms a rearward facing abutment 172 which is sized and shaped to cooperate with the spindle 168 to lock the refrigerator door 118 closed when in a locked position as described in more detail hereinafter. The retainer 142 can alternately or additionally be provided with vertically extending openings sized and positioned for receiving the upper end of the spindle 168 therein. The retainer 142 is preferably molded from a plastic material. The retainer 142 is provided with a camming surface 174 such that the spindle 168 is automatically moved downward to the unlocked position as the door 118 is closed. The rear end of the retainer 142 is provided with a downwardly extending flange 194 having an opening 196 therein. As best shown in FIG. 17, a suitable fastener 198 extends through the opening 196 to secure the retainer 142 to the refrigerator cabinet 114.

As best shown in FIGS. 14–17, the latch spindle 168 and the retainer 142 cooperate to lock the door 118 closed, that is, prevent the door 118 from opening. The door 118 is prevented from opening because the upper end of the spindle 168 engages the rearward facing abutment 172 of the retainer 142.

le;.5qWhen it is desired to open the door 118, the operator grasps the hand grip 148 with their hand and downwardly presses the actuator 170 of the latch 150. The downward movement of the actuator 170 overcomes the upward bias of the spring element 169 and downwardly moves the spindle 168 from the locked position to the unlocked position wherein the spindle 168 is not blocked by the abutment 172 of the retainer 142. Once the spindle 168 is in the unlocked position, the operator pulls on the hand grip 148 to pivot the door 118 open about the hinges 120. The spring element 169 resiliently returns the spindle 168 to the locked position when the actuator 170 is released by the operator.

When the door 118 is closed, the latch 150 of the locking handle 112 automatically locks the door 118. As the door 118 approaches the closed position, the upper end of the spindle 168 engages the camming surface 172 of the retainer 142 which downwardly moves the spindle 168 to the unlocked position. When the spindle 168 is rearwardly beyond the abutment 172, the spring element 169 resiliently returns the spindle 168 to the locked position and locks the door 118. The above described procedure is repeated whenever the door 118 is opened and closed.

It can be seen from the above description that the locking handle 112 of the present invention provides a positive lock which firmly holds the door 118 closed and can be easily and conveniently actuated to an unlocked position to open the door 118 with a single hand. Additionally, the door 118 is automatically locked when closed so that a separate locking manipulation, which may be inconvenient and/or forgotten, is not required. Furthermore, a manipulation separate from pulling the hand grip 148 is required to open the door 118.

Although particular embodiments of the invention have been described in detail, it will be understood that the invention is not limited correspondingly in scope, but includes all changes and modifications coming within the spirit and terms of the claims appended hereto.

What is claimed is:

1. A refrigerator comprising:

a cabinet defining an internal compartment having an opening; said cabinet having a retainer near said opening;

a door pivotally connected to said cabinet selectively closing and opening said opening to provide access to said compartment; and a locking handle including a mounting element rigidly secured to said door, a hand grip secured to said mounting element and non-movable relative to said mounting element, and a latch attached to said mounting element, said latch having a catch movable between a locked position and an unlocked position and an actuator movable relative to said handle and operably connected to said catch for moving said catch from said locked position to said unlocked position, wherein said catch and said retainer cooperate to prevent said door from opening when said catch is in the locked position and to allow said door to open when said catch is in the unlocked position; and wherein said latch is a spindle.

2. The refrigerator according to claimed 1, wherein said latch includes a spring element resiliently biasing said spindle to the locked position.

3. The refrigerator according to claim 1, wherein said actuator is attached to said spindle and axially moves the spindle.

4. The refrigerator according to claim 1, wherein said spindle is vertically extending.

5. The refrigerator according to claim 4, wherein said retainer is attached to said cabinet vertically above the door and has a rearward facing abutment adapted for cooperating with said spindle in the locked position to prevent said door from opening.

6. The refrigerator according to claim 5, wherein said retainer has a camming surface for automatically moving said spindle to the unlocked position as the door is closed and said latch includes a spring element resiliently biasing said spindle to the locked position.

7. A refrigerator comprising;

a cabinet defining an internal compartment having an opening, said cabinet having a retainer located vertically above the door and has a rearward facing abutment;

a door pivotally connected to said cabinet selectively closing and opening said opening to provide access to said compartment; and a locking handle including a mounting element rigidly secured to said door, a hand grip rigidly secured to said mounting element, and a latch attached to said mounting element, said hand grip being generally U-shaped with a main bar and forming a space between said mounting element and said main bar, said latch having spindle vertically extending and movable between a locked position and an unlocked position, a spring element upwardly biasing said spindle to the locked position, and an actuator moveable relative to said handle and operably connected to said spindle for axially moving said spindle downward from said locked position to said unlocked position, wherein said spindle and said abutment cooperate to prevent said door from opening when said spindle is in the locked position and to allow said door to open when said spindle is in the unlocked position.

8. The refrigerator according to claim 7, wherein said retainer has a camming surface for automatically moving said spindle to the unlocked position as the door is closed.

9. The refrigerator according to claim 7, wherein said refrigerator is a side-by side refrigerator.

* * * * *

UNITED STATES PATENT AND TRADEMARK OFFICE

CERTIFICATE OF CORRECTION

PATENT NO. : 6,296,285 B1
DATED : October 2, 2001
INVENTOR(S) : Gunnar Alvring et al.

It is certified that error appears in the above-identified patent and that said Letters Patent is hereby corrected as shown below:

Title page,
Inventors, please delete "Anderson" and insert therefor -- Andersson --;

Column 9,
Line 26, please delete "le;.5q"; and

Column 10, claim 2,
Line 18, please delete "claimed" and insert therefor -- claim --.

Signed and Sealed this

Sixteenth Day of April, 2002

*Attest:*

*Attesting Officer*

JAMES E. ROGAN
*Director of the United States Patent and Trademark Office*